US009932544B1

(12) United States Patent
Safdieh

(10) Patent No.: US 9,932,544 B1
(45) Date of Patent: Apr. 3, 2018

(54) PLAY MOLDABLE SOAP COMPOSITION

(71) Applicant: Abraham E. Safdieh, New York, NY (US)

(72) Inventor: Abraham E. Safdieh, New York, NY (US)

( * ) Notice: Subject to any disclaimer, the term of this patent is extended or adjusted under 35 U.S.C. 154(b) by 0 days.

(21) Appl. No.: 15/483,758

(22) Filed: Apr. 10, 2017

(51) Int. Cl.

| | |
|---|---|
| ***C11D 3/22*** | (2006.01) |
| ***C11D 3/34*** | (2006.01) |
| ***C11D 3/20*** | (2006.01) |
| ***C11D 13/14*** | (2006.01) |
| ***C11D 3/18*** | (2006.01) |
| ***C11D 3/04*** | (2006.01) |
| ***C11D 3/40*** | (2006.01) |
| ***C11D 3/43*** | (2006.01) |
| ***C11D 3/50*** | (2006.01) |

(52) U.S. Cl.
CPC ..... *C11D 3/222* (2013.01); *C11D 3/046* (2013.01); *C11D 3/18* (2013.01); *C11D 3/2006* (2013.01); *C11D 3/2048* (2013.01); *C11D 3/2079* (2013.01); *C11D 3/2093* (2013.01); *C11D 3/3409* (2013.01); *C11D 3/40* (2013.01); *C11D 3/43* (2013.01); *C11D 3/50* (2013.01); *C11D 13/14* (2013.01)

(58) Field of Classification Search
None
See application file for complete search history.

(56) References Cited

U.S. PATENT DOCUMENTS

| | | | | |
|---|---|---|---|---|
| 5,225,097 | A * | 7/1993 | Kacher | C11D 17/006 510/146 |
| 6,218,347 | B1 * | 4/2001 | Rau | C11D 1/65 510/151 |
| 9,593,298 | B2 * | 3/2017 | Cotrell | C11D 1/126 |
| 2004/0048759 | A1 * | 3/2004 | Ribble | A61K 8/046 510/141 |
| 2007/0275021 | A1 * | 11/2007 | Lee | A61K 8/22 424/401 |
| 2014/0155309 | A1 * | 6/2014 | Cotrell | C11D 1/126 510/152 |

* cited by examiner

*Primary Examiner* — Necholus Ogden, Jr.
(74) *Attorney, Agent, or Firm* — Ezra Sutton

(57) ABSTRACT

The present invention provides a starch-based moldable play composition, including: corn starch; mineral oil; propylene glycol; glyceryl stearate; sodium laureth sulfate; sodium chloride; potassium sorbate; phenoxyethanol; water; fragrance; and pigment dye, selected from the group consisting of yellow 3, yellow 4, red 14, red 17, blue 1, blue 2, and titanium dioxide.

2 Claims, 1 Drawing Sheet

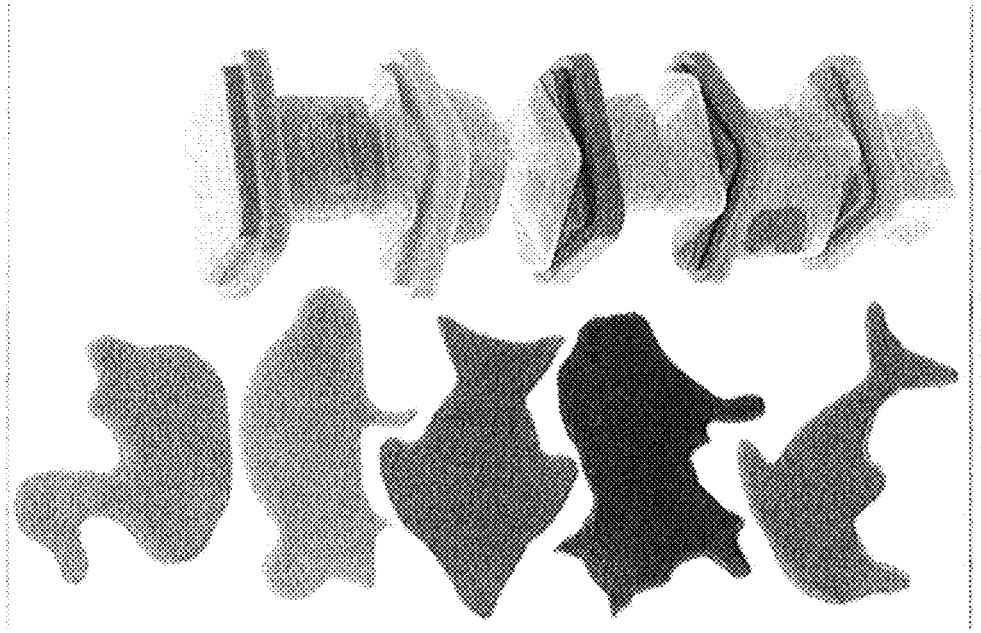

PLAY MOLDABLE SOAP COMPOSITION

FIELD OF THE INVENTION

The present invention relates to a starch-based moldable soap composition. The moldable soap composition remains moist, and is easily moldable while retaining its structural integrity such that it can be cleanly cut into pieces, molded into various shapes, and can even be put through an extruder.

BACKGROUND OF THE INVENTION

Washing one's body and hands with soap is an effective and simple way to avoid illness and infectious diseases. However, children, especially infants, are most prone to catching diseases and illness because they are often obstinate to washing. Thus, parents often have the difficult task of getting their children to take baths and wash their hands. One way parents try to encourage and motivate their children to wash is by making washing their bodies and hands enjoyable by playing with toys. This may be accomplished by disguising soap as playful toys. To this end, the prior art discloses starch based bath soap compositions that permit soap to be molded and played with by children, while retaining the inherent cleansing properties of soap.

However, the prior art moldable soap compositions are problematic because they are prone to being hard or brittle and do not retain their moldability after they are wet and may contain harsh chemicals that may irritate children's delicate skin. Thus, there is a need for a safe and non-irritating, moldable soap composition that has improved moldability, is soft, and maintains structural integrity even after it is exposed to water.

DESCRIPTION OF THE PRIOR ART

Starch based moldable compositions are known the art and are described in prior art U.S. Pat. No. 8,518,171 to Uang; U.S. Pat. No. 7,098,292 to Zhao; U.S. Pat. No. 6,713,624 to Doane; U.S. Pat. No. 5,972,092 to Abimael; U.S. Pat. No. 5,538,551 to Desbiens; U.S. Pat. No. 4,386,964 to Herbert; and U.S. Pat. No. 3,167,440 to McVicker. However, none of these prior art patents provide for an improved starch-based moldable soap composition, wherein the composition remains moist, soft, and is easily moldable while retaining its structural integrity, even when wet, such that it can be cleanly cut into pieces, molded into various shapes, and can even be put through an extruder.

OBJECTS OF THE INVENTION

It is an object of the present invention to provide to provide a play moldable soap composition that remains moist, soft, and is easily moldable while retaining its structural integrity such that it can be cleanly cut into pieces, molded into various shapes, and can be put through an extruder.

Another object of the present invention is to provide a play moldable soap composition that doesn't leave a powdery residue in the hands of the user.

Another object of the present invention is to provide a play moldable soap composition that can be molded and cut into shapes whether it is wet or not.

Another object of the present invention is to provide a play moldable soap composition that is reusable and soft even after it is wet and until it disappears.

Another object of the present invention is to provide a play moldable soap composition that is non-toxic and not irritable to the skin of the user.

SUMMARY OF THE INVENTION

The present invention provides a starch-based moldable play composition, including: corn starch; mineral oil; propylene glycol; glyceryl stearate; sodium laureth sulfate; sodium chloride; potassium sorbate; phenoxyethanol; water; fragrance; and pigment dye, selected from the group consisting of yellow 3, yellow 4, red 14, red 17, blue 1, blue 2, and titanium dioxide.

In addition, the play moldable soap composition can be molded into a caricature, animal, or other play configuration.

BRIEF DESCRIPTION OF THE DRAWINGS

FIG. 1 is a perspective view of the packaged moldable play composition and further showing the moldable play composition molded into various animal configurations.

DETAILED DESCRIPTION OF THE PREFERRED EMBODIMENT

The present invention provides for a starch-based moldable play composition, including: 55% by weight corn starch; 8% by weight mineral oil; 5% by weight propylene glycol; 8% by weight glyceryl stearate; 10% by weight sodium laureth sulfate; 3% by weight sodium chloride; 0.5% by weight potassium sorbate; 0.5% by weight phenoxyethanol; 9.12-9.63% by weight water; 0.15% by weight fragrance; and 0.1-1.0% by weight pigment dye, selected from the group consisting of yellow 3, yellow 4, red 14, red 17, blue 1, blue 2, and titanium dioxide.

Starch is an essential ingredient of the moldable play composition and can include corn starch, wheat starch, rice flour (glutenous and non-glutenous), potato starch, or tapioca starch.

Starch granules are made of polysaccharides (strings of sugar molecules) which include both amylose, a linear polysaccharide molecule, and amylopectin, a branched polysaccharide molecule that is formed by hydrogen bonds between the strands. Starches with a higher percentage of amylose make a stronger, firmer dough. Preferable starches have a sufficient amylose content to create a firm, yet moldable soap composition.

In the present invention corn starch was preferably used to make the moldable soap composition. The preferred weight percent of corn starch is 55% of the moldable soap composition. However starches, selected from the group consisting of: corn starch, wheat starch, rice flour (glutenous and non-glutenous), potato starch, or tapioca starch can also be used.

The corn starch is added to water which is preferably from 9.12% to 9.63% by weight of the moldable soap composition.

However, over time, the amylose strands in the starch-and water mixture begin to bind to each other which is called retrogradation. Retrogradation of the starch in the moldable soap composition results in it drying out and hardening. Accordingly, a retrogradation inhibitor or humectant is further added to the mixture which helps prevent retrogradation of the starch and helps soften the moldable soap composition. Preferably, propylene glycol is added to act as a retrogradation inhibitor and softener and is preferably 5% by weight of the moldable soap composition.

In addition, lubricants are added to further improve the texture and consistency of the moldable soap composition and to reduce the stickiness of the moldable soap. Preferably, mineral oil is added to the composition at 5% to 10% by weight of the moldable soap composition. Furthermore, glyceryl stearate is added to the composition to act as a surfactant and emulsifier to further improve the moisture and viscosity of the moldable soap. Preferably, glyceryl stearate is 8% by weight of the moldable soap composition.

Furthermore, a foaming agent is added to the mixture to facilitate the formation of foam, act as a detergent and a surfactant, and to further reduce the stickiness of the moldable soap on the hands of the user. Preferably, sodium laureth sulfate is used as a foaming agent. Sodium laureth sulfate (SLES), an accepted contraction of sodium lauryl ether sulfate (SLES), is an anionic detergent and surfactant found in many personal care products (soaps, shampoos, toothpaste etc.). It is an inexpensive and very effective foaming agent. The percentage of sodium laureth sulfate used is preferably 10% by weight of the moldable soap composition.

Salts are also added to the moldable soap composition which further stiffens the composition by reducing its moisture, preserves it, and adds some antimicrobial properties to the composition. Preferably, sodium chloride is added to the composition at 8% by weight of the moldable soap composition.

Additional preservatives are also added including potassium sorbate and phenoxyethanol. Specifically, potassium sorbate and phenoxyethanol are both added to the composition in amounts from 0.1% to 1.0% by weight of the moldable soap composition.

In order to make the moldable soap composition more appealing to the user, fragrances and dyes are also added. Specifically, fragrances are added to the composition at 0.1% to 1.0% by weight of the moldable soap composition. Also, pigment dyes, selected from the group consisting of yellow 3, yellow 4, red 14, red 17, blue 1, blue 2, and titanium dioxide, are also added in amounts from 0.1% to 1.0% by weight of the moldable soap composition.

Thus, the present invention provides a safe, non-toxic, and non-irritating, moldable soap composition that has improved moldability, is soft, and maintains structural integrity even after it is exposed to water. Further, the present invention provides a play moldable soap composition that remains moist, soft, and is easily moldable while retaining its structural integrity such that it can be cleanly cut into pieces, molded into various shapes, and can be put through an extruder. In addition, the play moldable soap of the present invention doesn't leave a powdery residue in the hands of the user, can be molded and cut into shapes whether it is wet or not, and is reusable and soft even after it is wet and until it disappears.

In the specification the terms "comprise, comprises, comprised and comprising" or any variation thereof and the terms "include, includes, included and including" or any variation thereof are considered to be totally interchangeable and they should all be afforded the widest possible interpretation.

Advantages of the Present Invention

An advantage of the present invention is to provide a play moldable soap composition that remains moist, soft, and is easily moldable while retaining its structural integrity such that it can be cleanly cut into pieces, molded into various shapes, and can be put through an extruder.

Another advantage of the present invention is to provide a play moldable soap composition that doesn't leave a powdery residue in the hands of the user.

Another advantage of the present invention is to provide a play moldable soap composition that can be molded and cut into shapes whether it is wet or not.

Another advantage of the present invention is to provide a play moldable soap composition that is reusable and soft even after it is wet and until it disappears.

Another advantage of the present invention is to provide a play moldable soap composition that is non-toxic and not irritable to the skin of the user.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A play moldable soap composition comprising a starch-based moldable play composition, comprising:

a) 55% by weight corn starch;
b) 8% by weight mineral oil;
c) 5% by weight propylene glycol;
d) 8% by weight glyceryl stearate;
e) 10% by weight sodium laureth sulfate;
f) 3% by weight sodium chloride;
g) 0.5% by weight potassium sorbate;
h) 0.5% by weight phenoxyethanol;
i) 9.12-9.63% by weight water;
j) 0.15% by weight fragrance; and
k) 0.1-1.0% by weight pigment dye, selected from the group consisting of yellow 3, yellow 4, red 14, red 17, blue 1, blue 2, and titanium dioxide; and wherein said play moldable soap composition remains moist and soft, is easily moldable, and retains its structural form even when wet.

2. The play moldable soap composition of claim 1 wherein said play moldable soap composition can be molded into a caricature, animal, or other play configuration.

* * * * *